US006681503B2

(12) United States Patent
Morle

(10) Patent No.: US 6,681,503 B2
(45) Date of Patent: Jan. 27, 2004

(54) DOUBLE TONGUE SOCCER BOOT/ TRAINING SHOE

(76) Inventor: Kenneth Alexander Morle, 1060 Kirk Rd. RR#2, Binbrook, Ont (CA), L0R-1C0

( * ) Notice: Subject to any disclaimer, the term of this patent is extended or adjusted under 35 U.S.C. 154(b) by 22 days.

(21) Appl. No.: 09/988,478

(22) Filed: Oct. 29, 2001

(65) Prior Publication Data

US 2002/0029496 A1 Mar. 14, 2002

(51) Int. Cl.[7] ..... A43B 5/00
(52) U.S. Cl. ..... 36/99; 36/54; 36/133
(58) Field of Search ..... 36/99, 54, 133

(56) References Cited

U.S. PATENT DOCUMENTS 3,525,165 A * 8/1970 Randall, Jr. ..... 36/133
3,650,051 A * 3/1972 Sass ..... 36/133
4,377,913 A * 3/1983 Stone ..... 36/99
5,154,011 A * 10/1992 Holzl et al. ..... 36/117.2
5,437,112 A * 8/1995 Johnston ..... 36/128
5,701,688 A * 12/1997 Crowley ..... 38/72 R
D433,212 S * 11/2000 Morle ..... D2/905
6,408,542 B1 * 6/2002 Shepherd ..... 36/54
6,421,936 B1 * 7/2002 Gerrand ..... 36/133

* cited by examiner

*Primary Examiner*—M. D. Patterson

(57) ABSTRACT

A Soccer Boot/Training Shoe with an external tongue that has upon it rubberized ball agitators for applying spin to a soccer ball. The agitators are furrowed, curved and increase in size from front to back. The external tongue is secured to the boot by lace and loops. These loops are placed on the tongue and the boot. Laces are passed through these loops alternately to secure the tongue in place.

2 Claims, 7 Drawing Sheets

Fig. - 8
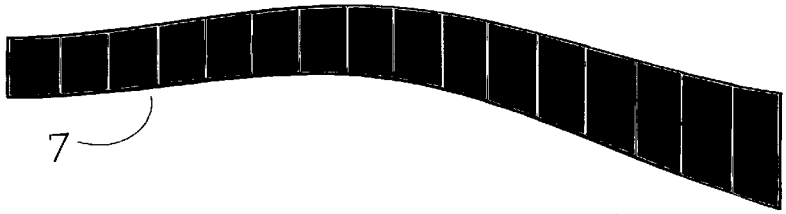
Fig. - 9
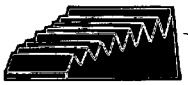
Fig. - 10
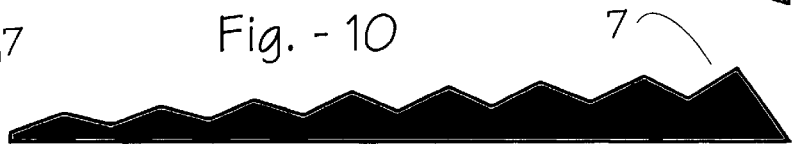
Fig. - 11
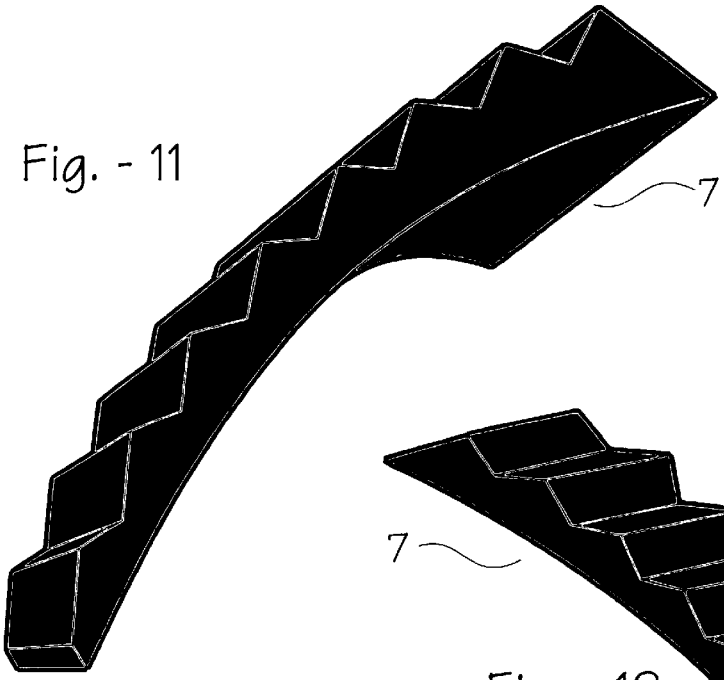
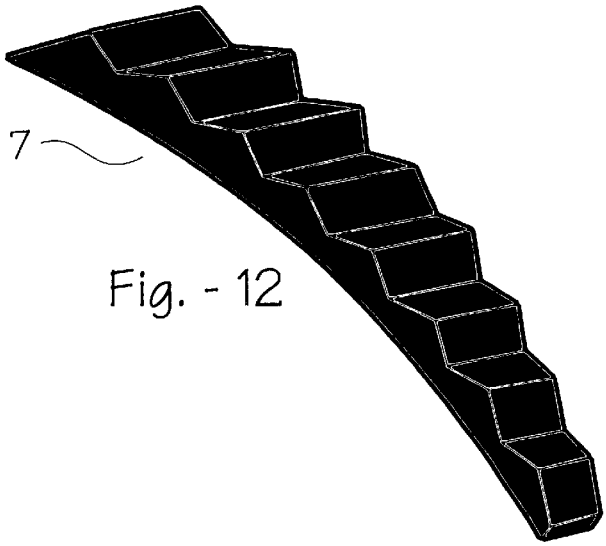
Fig. - 12

DOUBLE TONGUE SOCCER BOOT/ TRAINING SHOE

CROSS-REFERENCE TO RELATED APPLICATIONS

U.K. 2070402 Nov. 11, 1997 U.S. Pat. No. D433,212 Nov. 7, 2000

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

This invention relates to footwear worn in a game of soccer.

At present soccer boots have rough stitching or bits of rubber attached to induce the ball to spin. These can only be placed on areas of the boot which remain when the laces are in position. Therefore the stitching and bits of rubber are not always in the place that comes in contact with the ball, when the boot kicks the ball.

The Double Tongue Soccer Boot/Training Shoe provides a clear surface, by employing an external tongue for the placement of ball agitators. These agitators are shaped and located in such a way to come in contact with the ball during the general motion of kicking a ball.

The furrows, rising contour, increasing size and curved shape of the agitators enable them to stay in contact with the ball throughout the motion of kicking the ball, thus inducing greater spin.

BRIEF SUMMARY OF THE INVENTION

This invention relates to footwear worn in a game of soccer. The object of this invention is to provide better ball agitators for inducing a ball to spin. A spinning ball will travel in an arc or curved path.

At present soccer boots have rough stitching or bits of rubber attached to induce a ball to spin. The lace on these boots take up a considerable amount of space, leaving only a minimum area for the placement of rough stitching or bits of rubber. Since the laces are in the main area of the boot that is used to kick the ball, the rough stitching or bits of rubber can not be placed in the most effective position.

The Double Tongue Soccer Boot/Training Shoe solves this problem by the use of an external tongue, that provides a clear surface for the placement of ball agitators.

These agitators are furrowed with a rising contour, that increase in hight and size from front to back, and are also curved in shape. This enables the agitators to keep in contact with the ball throughout the motion of kicking the ball.

The external tongue is secured to the boot by lace and loops. The loops are placed on the external tongue and the boot in a staggered fashion, so that the loops on the external tongue aline and fit between those on the boot when the tongue is closed.

BRIEF DESCRIPTION OF THE SEVERAL VIEWS OF THE DRAWING

FIG. 8 is a plan view showing a ball agitator of the Double Tongue Soccer Boot/Training Shoe;

FIG. 9 is a front view of FIG. 8;

FIG. 10 is a side view of FIG. 8;

FIG. 11 is a perspective view of FIG. 8;

FIG. 12 is another perspective view of FIG. 8, and

DETAILED DESCRIPTION OF THE INVENTION

Figure 1:
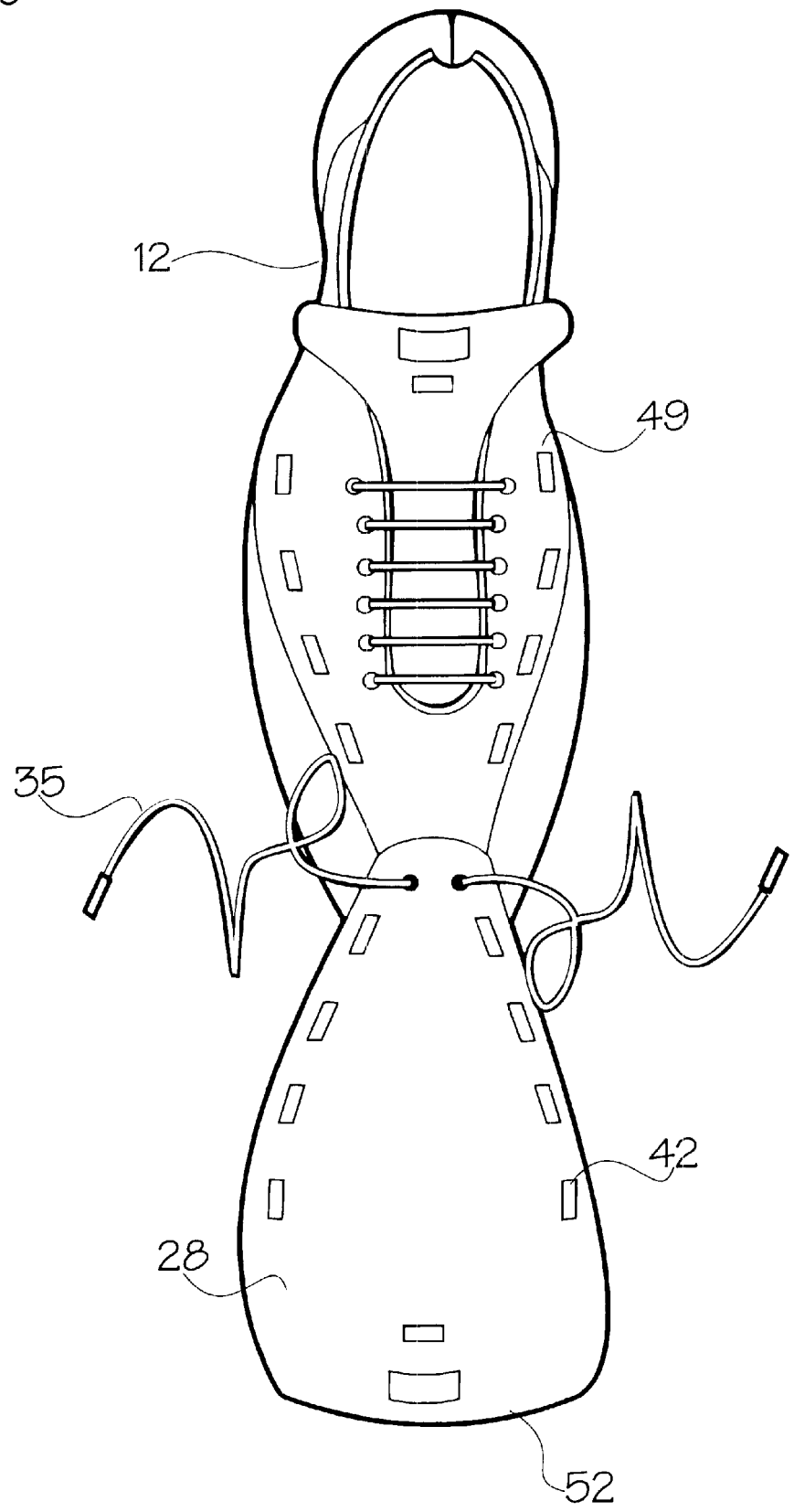
FIG. 1 is a top plan view of a Double Tongue Soccer Boot/Training Shoe.
Figure 7:
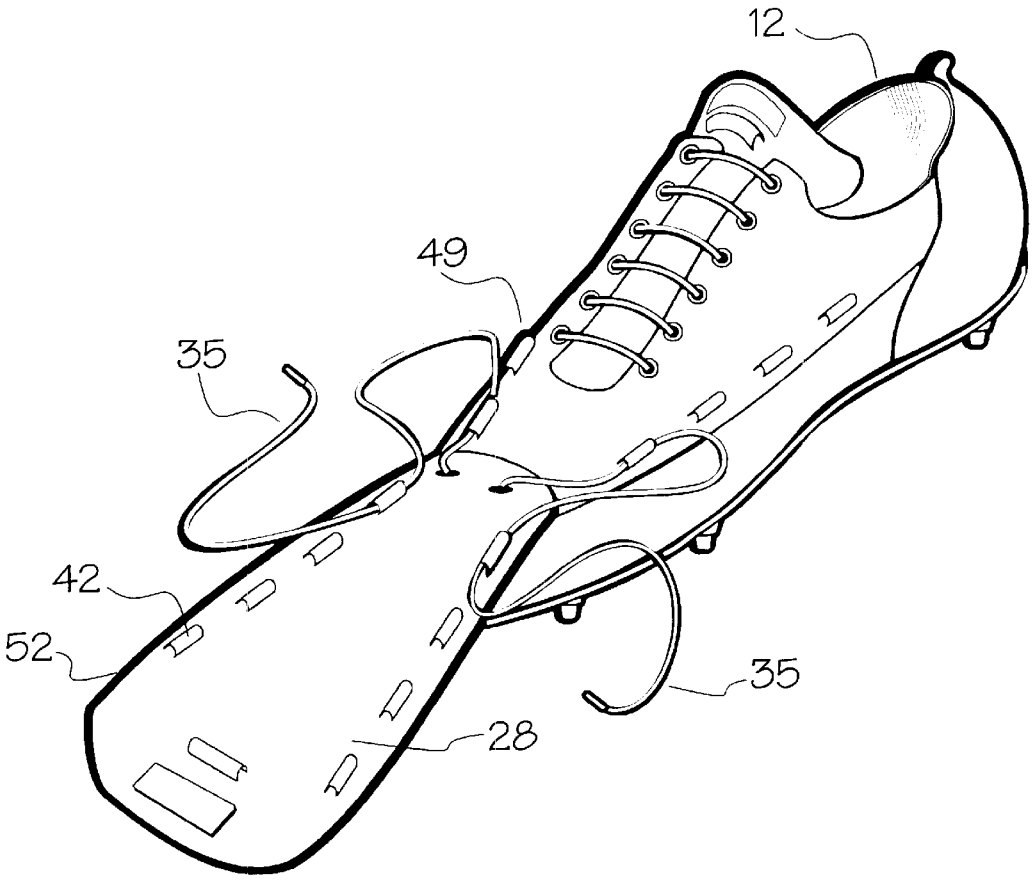
FIG. 7 is a perspective view of FIG. 1.

Referring to FIG. 1 a Double Tongue Soccer Boot/ Training Shoe, also depicted in FIG. 7 with the external tongue in an open position, revealing the lacing mechanism. This consists of lace and loops on the tongue and boot. The loops are staggered so when laces are passed through alternately, boot, tongue etc. FIG. 7 the tongue closes and the loops on the tongue fit between those on the boot. In this way the external tongue is secured to the boot.

Figure 2:
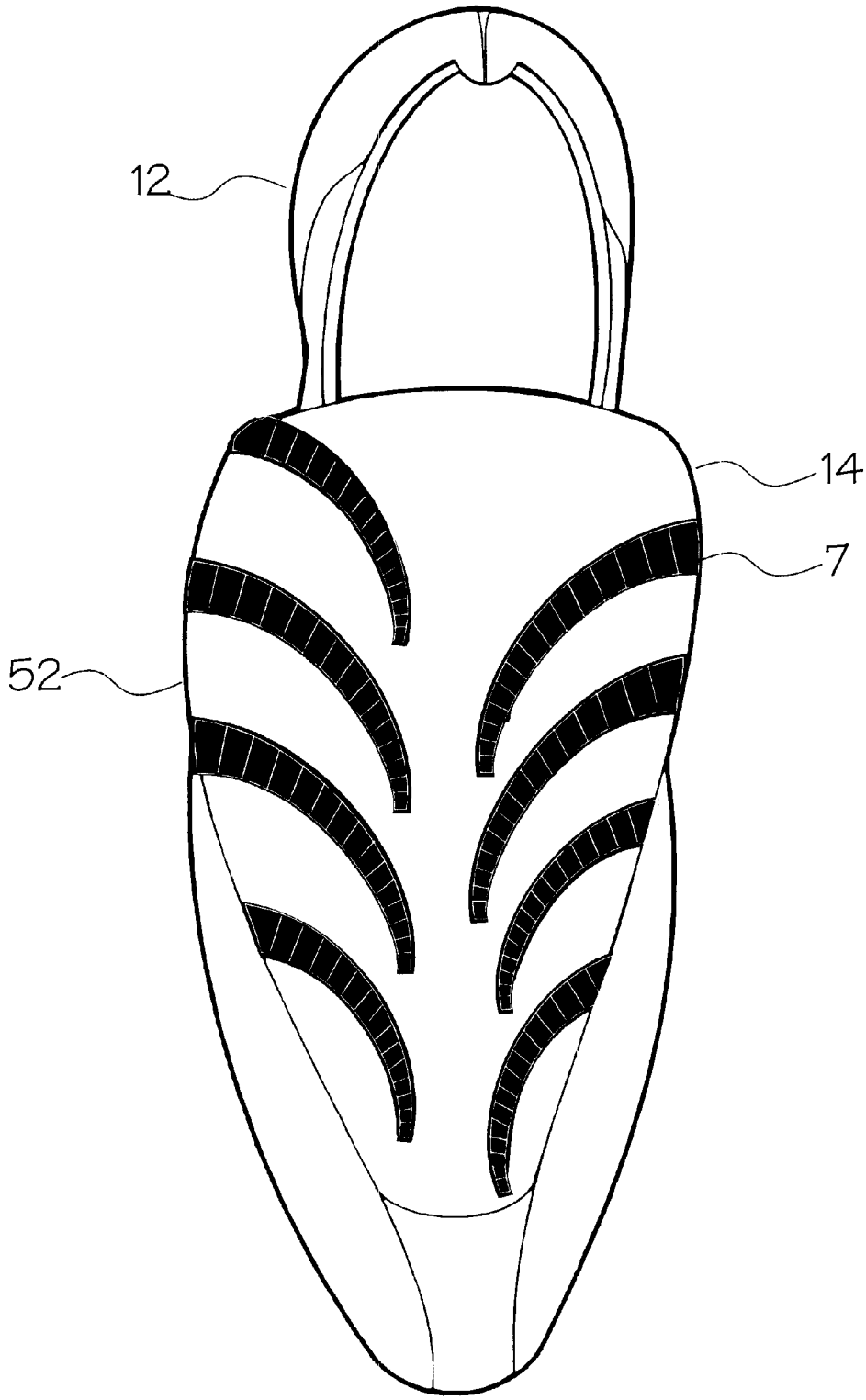
FIG. 2 is a top plan view thereof, in the closed position.
Figure 3:
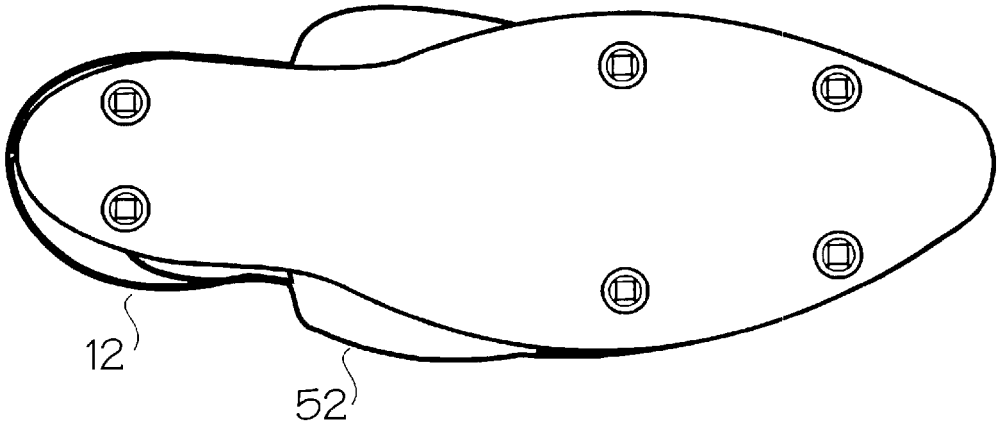
FIG. 3 is a bottom plan view of FIG. 2.
Figure 4:
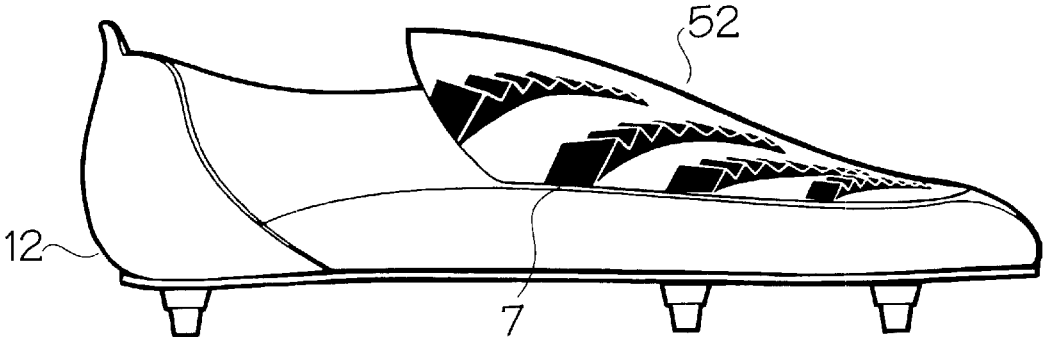
FIG. 4 is a side view of FIG. 2.
Figure 5:
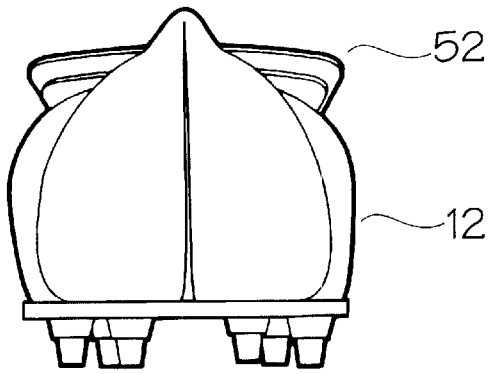
FIG. 5 is a rear view of FIG. 2.
Figure 6:
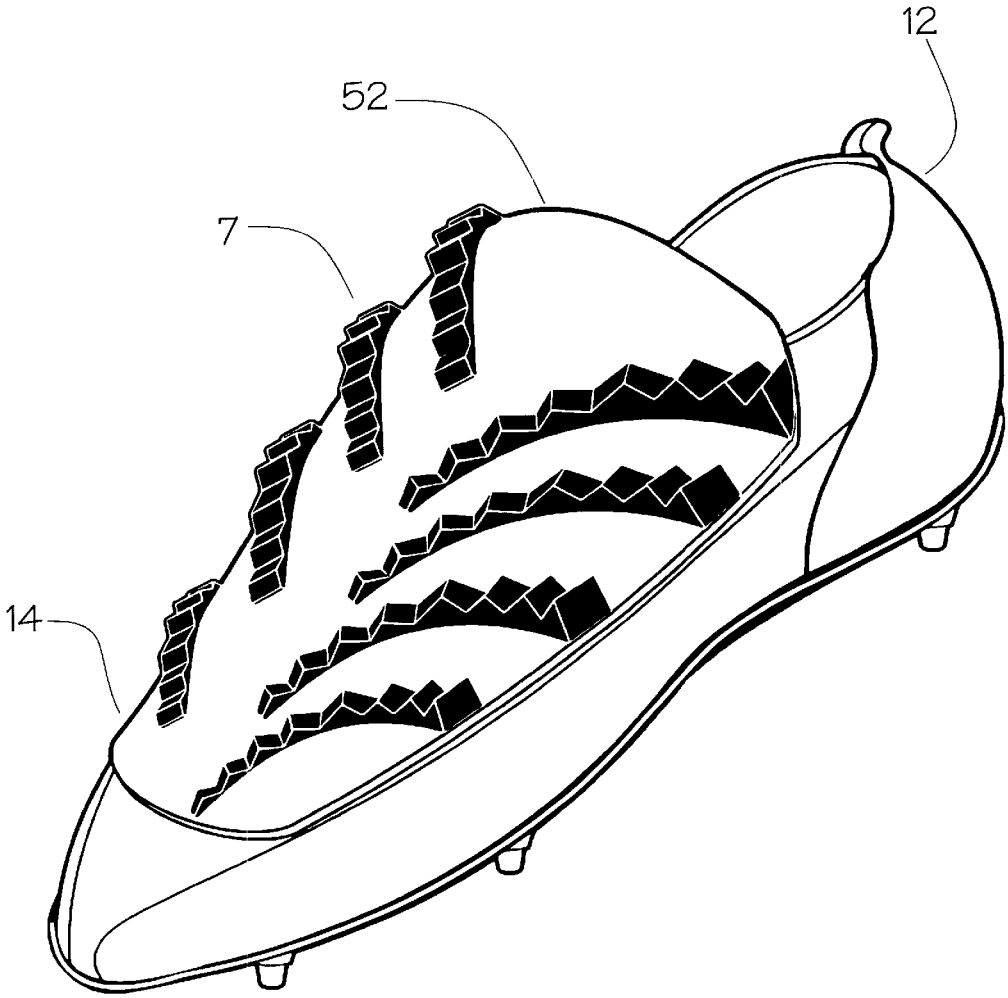
FIG. 6 is a perspective view of FIG. 2.

With the tongue secured to the boot, the ball agitators are visible FIG. 2, FIG. 4 and FIG. 6. The ball agitators curve outwards FIG. 8 towards the sides of the tongue. They increase in hight and size FIG. 9, FIG. 10, FIG. 11 and FIG. 12 as they curve towards the outer edge of the tongue.

When a ball is kicked it passes over the furrows of the agitators, thus applying spin to the ball. The rising contour, increasing hight and size helps to keep the agitators in contact with the ball, since the ball will begin to move up and away on first contact.

The outward curve of the agitators FIG. 2 helps the agitators to keep in contact with the ball since they curve in the direction in which the foot and the boot is moving and also in the direction in which spin is applied to the ball. Hence there are two sets of agitators. One curving in the opposite direction from the other. One set for clockwise spin of the ball the other for counterclockwise spin of the ball.

The ball agitators are made from durable rubber that will withstand the friction of a soccer ball passing over them constantly.

At present, boots have rough stitching or bits of rubber to apply spin to a soccer ball. They are not technically shaped, they are only rough and uneven surfaces. Rough stitching and bits of rubber are placed in the toe region and the areas at the sides of the toes, since these are the only areas available when a conventional boot lace is in place. These areas do not always make contact with the ball when it is kicked.

Figure 13:
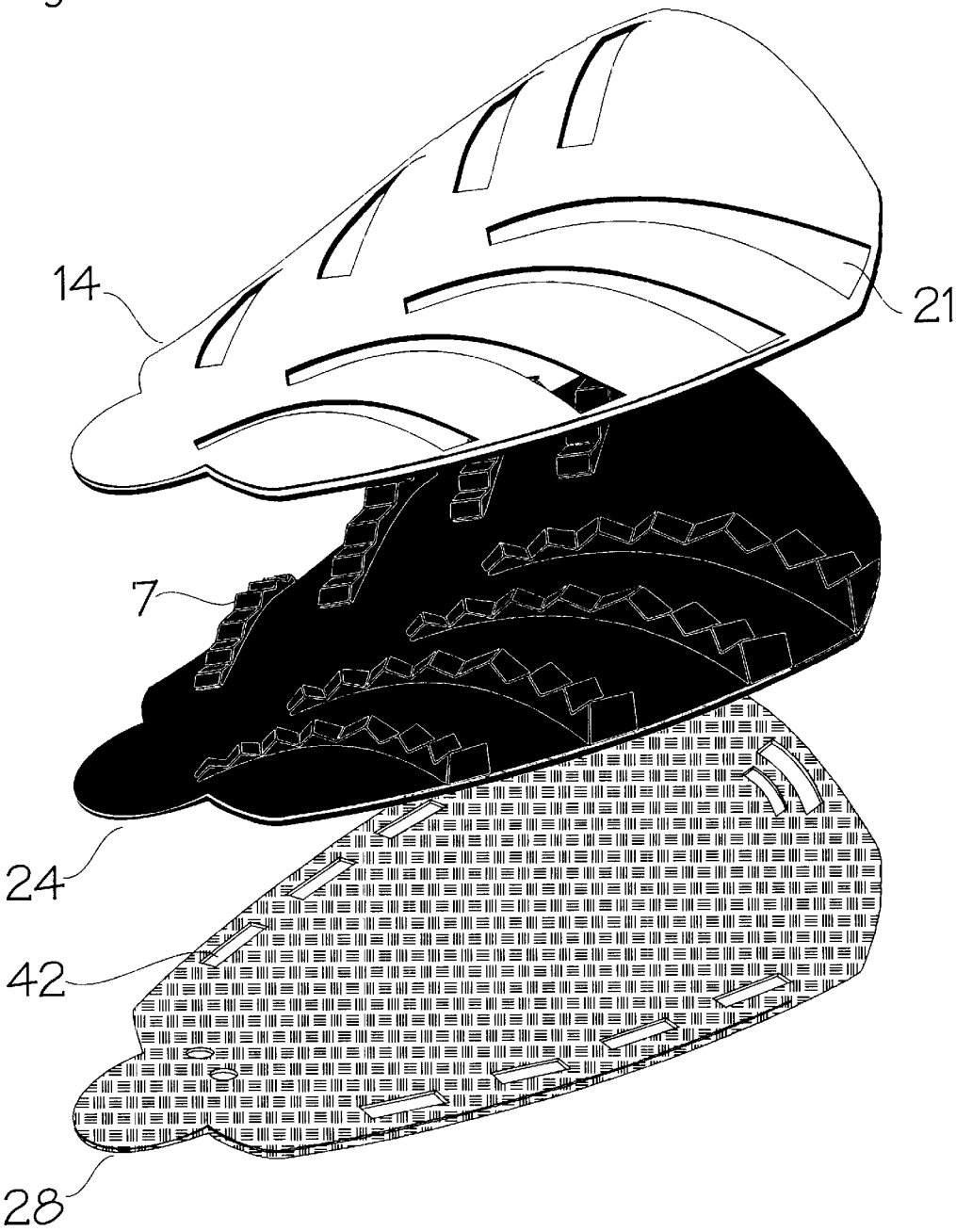
FIG. 13 is a perspective view of the tongue assembly of the Double Tongue Soccer Boot/Training Shoe.

Referring to FIG. 13 the tongue assembly, which consists of three parts. The outer layer, the agitator plate and the underpad. The outer layer 1 made of leather or the usual synthetic material used in making soccer boots. It has slots that are shaped to fit over the agitators so that the agitators protrude. The outer layer gives support to the agitators.

The agitator plate 2 is made of moulded rubber for uniform positioning of the agitators. Also for possible replacement of worn out agitators.

The underpad 3 contains the lacing mechanism as shown in FIG. 7, gives added protection to the instep from cleats and the constant pressure of kicking a ball. The underpad is made of light padding material to which the lace is attached and the loops are stitched.

The outer layer 1 the agitator plate 2 and the underpad 3 are stitched together, supporting and reinforcing the agitator plate. The tongue assembly is then stitched to the boot.

Securing the external tongue to the boot could have been achieved with a variety of different fasteners. With the absence of metal or sharp components, the lacing mechanism does not pose a hazard to feet or other players.

Though the preferred embodiment of a Double Tongue Soccer Boot/Training Shoe has been shown and described, it is understood that the size and number of agitators may vary due to the size of the boot.

The invention is defined in the following claims.

I claim:

1. A Double Tongue Soccer Boot/Training Shoe, consisting of an external tongue with ball agitators of a curved shape with furrows, a rising contour that increases in height and size from front to back, located on said tongue.

2. A Double Tongue Soccer Boot/Training Shoe, consisting of an external tongue having ball agitators of a curved shape with furrows, a rising contour that increases in hight and size from front to back, located on said tongue; which is secured in position by a lace and loops mechanism that has loops on both the tongue and the boot, which are staggered for laces to pass through alternately to secure external tongue to the boot.

* * * * *